US006193764B1

(12) United States Patent
Herrera

(10) Patent No.: US 6,193,764 B1
(45) Date of Patent: Feb. 27, 2001

(54) WATER, ENERGY, AND TIME EFFICIENT REACTIVE RAPID DYEING SYSTEM

(75) Inventor: Farid Akram Atala Herrera, Lima (PE)

(73) Assignee: Farid A. Atala, Lima (PE)

( * ) Notice: Subject to any disclaimer, the term of this patent is extended or adjusted under 35 U.S.C. 154(b) by 0 days.

(21) Appl. No.: 09/295,294

(22) Filed: Apr. 20, 1999

(51) Int. Cl.[7] ..... D06P 3/66; D06P 1/38; D06P 1/382; D06P 1/384; D06L 3/02

(52) U.S. Cl. ..... 8/543; 8/549; 8/918; 8/931; 8/111

(58) Field of Search ..... 8/111, 400, 543, 8/549, 931, 918, 552, 588

(56) References Cited

U.S. PATENT DOCUMENTS 4,063,877 * 12/1977 Elliot et al. .
4,645,510 * 2/1987 Hasler et al. .
5,167,668 * 12/1992 Hahnke et al. .

FOREIGN PATENT DOCUMENTS

1488862 * 10/1977 (GB) .

* cited by examiner

*Primary Examiner*—Margaret Einsmann

(57) ABSTRACT

A process for dyeing cellulosic containing textile materials with fiber reactive dyestuffs whereby from the scouring thru the after-scouring's final rinse less than 5 hours are required and only from 5 to 6 liquor baths are used. Material to be dyed is prepared for dyeing in 10 to 15 minutes at the boil, dyeing is performed in the next bath with no intermediate rinse. Glacial acetic acid, auxiliaries, and dyestuffs are added to the dye bath along with specified amounts of electrolyte, and after the required dyeing temperature is reached specified amounts of alkali are added to the dye bath and the materials subjected thereto at proper time-temperature relationships for level dyeing of a particular shade. Dyestuffs, electrolyte, and alkali are added to the dye bath in one portion with no dosing in a time period of from about 5 to 10 minutes each. The material is neutralized and soaped simultaneously.

26 Claims, No Drawings

WATER, ENERGY, AND TIME EFFICIENT REACTIVE RAPID DYEING SYSTEM

BACKGROUND

1. Field of Invention

The invention relates to a novel water, energy, and time efficient reactive rapid dyeing process for the dyeing of cellulosic containing textile materials with fiber reactive dyestuffs whereby from scour through after-scour a total process time of less than 5 hours are employed and only from 5 to 6 liquor baths are required.

2. Description of Prior Art

Numerous processes have heretofore been utilized for the dyeing of textile materials such as fibers, yarns and fabrics with wide divergence among the process parameters, depending upon the particular material being dyed, and the particular type of dyestuff being employed. Of particular importance are processes that have been utilized to dye cellulosic textile materials with fiber reactive dyes.

In utilizing the conventional fiber reactive dyeing process, not only is the dyeing operation expensive and time consuming, but the process is particularly energy intensive. With different baths, sometimes as many as 12 or 14, substantial energy is expended for raising the bath temperature from ambient to elevated temperature conditions at several intervals during the process. Moreover considerable rework is necessary due to shade variability and unlevel dyeings due to strike rate and hydrolysis of reactive dyes and unnecessary dyestuffs and chemicals are therefore wasted in larger amounts; and the protracted length of time required to complete the dyeing reduces the production capacity of the dyeing equipment.

Presently, the availability of energy adequate to run energy intensive dyeing operations is of major concern, not to mention the tremendous cost of same. Consequently much effort has been devoted to improving dyeing processes, attempting to reduce energy requirements necessary for the dyeing of all materials, particularly cotton and viscose rayon with fiber reactive dyes which are notoriously expensive and time consuming using state of art techniques.

Heretofore, many different processes have been proposed for the dyeing of cellulose containing materials with fiber reactive dyes, although most of the work has been done on the dyeing part of the process, not much work has been done on the approach of involving the scouring, the dyeing, and the after-scouring as a one process per se. For example, U.S. Pat. No. 5,356,444 to Schwarz, Max; Wolff, Joachim; Hildebrand, Dietrich; Grutze, Joachim; Hoppe, Manfred; Stawitz, Josef-Walter; Schulz, Rolf (Oct. 18, 1994)

Bayer Aktiengesellschaft recommends the following conventional fiber reactive dyeing and after-scouring procedure from the Prior Art U.S. Pat. No. 5,356,444:

100 parts of bleached cotton knitted goods and 3 parts of a phthalocyanine reactive dyestuff mixture are added to 1000 parts of aqueous dye liquor on a winch vat at 60 degrees C.

After the dyestuff mixture has become uniformly distributed in the liquor and on the cotton over a period of 15 minutes, 50 parts of sodium chloride are introduced into the dye liquor over a period of 30 minutes and 10 parts of sodium carbonate are then added at intervals of 10 minutes as 3 portions respectively comprising 1 part, 2 parts and 7 parts. The batch is then heated to 80 degrees C. in the course of 30 minutes and the goods are treated at this temperature for 30 minutes. After cooling, the liquor is then drained off and the goods are rinsed twice at 60 degrees C. and twice at 80 degrees C. They are then extracted at the boil for 15 minutes and the wash liquor is dried off. After cold rinsing, a level turquoise dyeing with good fastness properties is obtained.

It can be seen from the above-mentioned example that the electrolyte is dosed in a time period of 30 minutes, and that the alkali is also dosed in a time period of 30 minutes. In addition, six baths are used for the after-scouring with a combined temperature raise of 255° C.

U.S. Pat. No. 4,359,322 to Neal, Bobby L.; Lowman,Steven R. (Nov. 16, 1982)

On the pre-scour operation of the goods, according to Neal in the Prior Art on U.S. Pat. No. 4,359,322, the goods are taken to 212° F. (100° C.), and run 30 to 45 minutes at said temperature, several rinses and an acid sour at 1 20° F. (50° C.), that is to say a total of 5 baths just for the pre-scour operation.

U.S. Pat. No. 5,364,416 to Schwarz, Max; Grutze, Joachim; Hildebrand, Dietrich; Wolff, Joachim; Stohr, Frank-Michael (Nov. 15, 1994)

Conventional after-scouring procedures are time consuming, energy intensive and of very high water consumption and effluents, as can be observed from the Prior Art U.S. Pat. No. 5,364,416 where after the dyeing procedure 2 warm water rinses at 50° C., 2 hot water rinses at 80° C., soaping at the boil for 15 to 20 minutes with suitable detergent, and cold water rinses until water is clear are performed in order to achieve good wash-fastness properties from a 2% fiber reactive dyed material, that is a total of seven water baths just for the after-scouring operation, plus a combined temperature rise of 235° C.

U.S. Pat. No. 5,554,199 to Baumann; Hans-Peter (Sep. 10, 1996)

It is of common practice to add the alkali fixing dyestuff agent in several parts and at 5 to 10 minutes intervals during dyeing, as stated by Baumann in the Prior Art U.S. Pat. No. 5,554,199, where as stated in Application Examples A and B, after waiting a 30 minute period for the dyestuff exhaustion to take place, 5 additions of alkali at 5 minute intervals are made; the problem with this procedure being that its very hard to achieve perfect lot-to-lot color repetition, different strike rates causing shade variability and increasing undesirable reworks plus the fact that its time consuming.

U.S. Pat. No. 5,833,720 to Kent, Johnny Joe; Lee, Eric C. S.; Yu, Sui-Fung (Nov. 10, 1998)

Just on the preparation of the fabrics, according to Kent et al. in Prior Art U.S. Pat. No. 5,833,720, four full water baths are used, and while the temperature was set to 70° C. and was held for 30 minutes, its well known to all skilled in the art that a much more efficient preparation of cotton materials take place at the boil.

In addition, according to the Prior Art U.S. Pat. No. 5,833,720, the energy efficient dyeing process works only with bifunctional reactive dyes, which is a big limitation to their dyeing process, since all the other type of fiber reactive dyestuffs will not work with their process.

U.S. Pat. No. 5,330,541 to Hall, David M.; Leonard, Tony M.; Cofield, Charles D.; Barrow, Hugh W. (Jul. 19, 1994)

As for the Dyeing time according to Hall et al. in the Prior Art U.S. Pat. No. 5,330,541 the average dyeing time of fiber reactive dyes is between 3 to 6 hours, and that with his process he can reduce the dyeing time from about 2½ to about 3 hours, and to this time you have to add the preparation of the material time plus the conditioning of the material time which add up to an additional 3½ to 4 hours, which at best will be 6 hours. Another disadvantage of the process of the Prior Art U.S. Pat No. 5,330,541 is that 5 water baths are required just for the preparation and conditioning of the cellulosic materials.

U.S. Pat. No. 4,562,604 to Damm, Sture (Jan. 7, 1986)

According to Damm, in the Prior Art U.S. Pat. No. 4,562,204, "if one used dyeing agents and optimum dyeing temperature of the dye bath, containing dyeing agent and electrolyte, adds all necessary alkali initially, one obtains with a great likelihood an uneven dyeing, as the fixation to the fibres is initiated at a high speed and reaches after a few minutes high values. On the other hand one can not reduce the amount of alkali, as it is necessary for attaining the end fixation value at a certain given dyeing time and consequently necessary for the reproducibility of the dyeing. The alkali is added after that the recommended dyeing temperature has been reached. As one can expect a not desired fast start of the fixation, the required amount of alkali must in usual manner be added in portions and at time intervals. These facts are known in several publications, for example in [Le Mustercarte 1350] from Bayer AG".

Which prove to be true for conventional fiber reactive dyeing processes, but at the same time these procedures are long and time consuming, and to this we have to add the disadvantage of having to spend money on expensive and sophisticated alkali dosing equipment devices like the one that Damm proposes in the Prior Art above mentioned, U.S. Pat. No. 4,656,846 to Damm, Sture (Apr. 14, 1987) and also on his device proposed in the Prior Art U.S. Pat. No. 4,656,846, where the alkali is dosed in portions by means of an expensive sophisticated electronically programmed controlled dosing device.

U.S. Pat. No. 5,152,802 to Berger, Faize; Becker, Klaus; Hartschen, Christa; Wahle, Bernd; Schenker, Gilbert; Baehr, Bemd-Dieter (Oct. 6, 1992)

According to Berger et al. in the Prior Art U.S. Pat. No. 5,152,802, dyeing with fiber reactive dyes is performed simultaneously with a 4 component anionic and non-ionic surfactant composition without a pre-scouring operation, thus saving time in the process, but unfortunately good level dyeings are difficult to obtain even if the dyestuff formulation comprises just one dye, as can be seen in example 2, table 2 in the Prior Art U.S. Pat. No. 5,152,802 where dyeing levelness is assessed by them a 2–3 rating (1=very good, 6=very bad) on a 2% Levafix Brilliant Blue E-BRA dyeing, leaving one to wonder what kind of ratings could be obtained with 2 and 3 dyestuff formulae combinations. Besides, Berger et al. make no mention whatsoever as for the dyeing time employed in the dyeing process of their invention.

U.S. Pat. No. 4,976,743 to Ohba, Noriaki; Tabata, Yujin; Nagatsuka, Masaaki; Nagatomi, Tateyuki; Klicker, Helmut (Dec. 11, 1990)

In the Prior Art U.S. Pat. No. 4,976,743 (Ohba et al.) describes a leveling agent composition for the treatment of cellulosic fibers that results in improved dyeability with reactive dyes without the need of dosing of alkali or electrolyte, but no mention is made about complete process time, preparation or pre-scouring and after-scouring mode or time, nor amount of water used throughout the entire process, although the 18 comparative examples demonstrated by Orba et al. were runned using a very high 20:1 liquor to fabric ratio.

U.S. Pat. No. 5,015,262 to Ohba, Noriaki; Tabata, Yujin; Nagatomi, Tateyuki (14/0511991)

In the Prior Art U.S. Pat. No. 5,015,262, again Ohba et al. propose a dye leveling agent, based on phospholipid type-compounds, whereby no dosing of alkali is needed, making the process shorter, thus saving time, but according to their invention, hot reactive dyes can not be dyed by their procedure, since the dyeing curves they propose are performed either isothermally at 50° C. as shown in FIG. 1, or at 60° C. as shown on FIG. 2, which is a limitation to their process; also, both dyeing curves take 130 minutes, to which you have to add pre-scouring time plus after-scouring time. Besides, all their experiments are runned with a single dyestuff leading one to wonder what the results would be if 2 or 3 dyestuff combination formulas are used. Again, all tests were performed using a very high 20:1 liquor to goods ratio.

U.S. Pat. No. 4,515,596 to Berendt, Hans-Ulrich; Pacher, Marielise (May 7, 1985)

According to Berendt et al, on The Prior Art U.S. Pat. No. 4,515,596 the scour/bleach operation is performed simultaneously in the after-scouring step, thus dyeing is done on the grey materials, in such a way that the scouring time is saved, but among the many problems we encounter with this process are: (a) only works with a limited combination of fiber reactive dyes; (b) works only with light shades and one dye color formulations as demonstrated on all the examples given; (c) the exhaustion dyeings were all performed using a 40:1 liquor ratio which is highly uneconomical considering that 20% hydrogen peroxide has to be used for bleaching; (d) does not favor the environment; and (e) natural fibers vary in dyeability depending not only on their kind and locality but also on their chemical pretreatment such as scouring and bleaching, it is therefor necessary to establish the proper scouring conditions for the dyeing steps to be able to get good reproducibility and uniform dyeings.

The American Cotton Handbook, volume two, page 760 states that the amount of water needed to process one pound of cotton will run anywhere from forty to seventy gallons, while with this novel process of the present invention the amount of water needed will be about 6 to 7 gallons per pound of cotton processed, that is to say only about 10% of the water required according to the American Cotton Handbook.

In general, the five, and six bath process according to teachings of the present invention is neither taught nor suggested by the known prior art.

OBJECTS AND ADVANTAGES

The five, and six bath process according to teachings of the present invention is neither taught nor suggested by the known prior art, and accordingly several objects and advantages of the present invention are to provide a method for increasing the rate of production of fiber reactive dyed cellulose containing materials per dyeing machine by as much as 60%, to decrease costs of production and save in energy and water consumption.

Other objects and advantages of the present invention are to provide a process which will enable us to obtain outstanding lot-to-lot color reproduction and a reduced hydrolysis dyeing mechanism resulting in more fiber reactive dye being bonded to the substrate thus better color yield.

Still another object and advantage of my invention is to provide tremendous savings in water consumption with positive effects on the environment, where as much as 50% reduction in water consumption and effluents by virtue of the novel process of the present invention are achieved.

Yet another object and advantage of the present invention is to provide a water, energy, and time saving and efficient process for dyeing cellulosic containing materials that is suitable for all types of fiber reactive dyestuffs.

Additional objects and advantages are a reduced process cycle time with an easy-to-use method and to do so in a manner that has ecological benefits.

In utilizing the conventional fiber reactive dyeing process, not only is the dyeing operation expensive and time consuming, but the process is particularly energy intensive, With different baths, sometimes as many as 12 or 14, substantial energy is expended for raising the bath temperature from ambient to elevated temperature conditions at several intervals during the process. Moreover considerable rework is necessary due to shade variability and unlevel dyeings due to strike rate and hydrolysis of reactive dyes and unnecessary dyestuffs and chemicals are therefore wasted in larger amounts; and the protracted length of time required to complete the dyeing reduces the production capacity of the dyeing equipment.

It can be seen from the conventional dyeing processes that just on the after-scouring operation 6 or 7 liquor baths are used, and also that the temperature is raised a combined total of 255° C., which more than triple's the energy consumption of the after-scour process of the present invention. If we consider that for the scouring and preparation of the materials to be dyed, the normal average for conventional fiber reactive dyeing methods requires 5 liquor baths, plus an average of 6 liquor baths for the after-scouring, plus the dyeing bath and the neutralizing bath we have a total of 13 liquor baths against only 5 or at the most 6 of the present invention.

In dyeing cellulose containing materials according to teachings of the present invention, a significantly shorter dye cycle from scour through after-scour is realized, whereby significantly less energy is required for the overall process, and whereby less labor is utilized per pound of goods processed; with the use of the dyeing process of the present invention any color can be dyed from scour through after-scour in less than 5 hours and using only from 5 to 6 liquor baths. Such of course reduces the overall cost of the dyeing operation, raises the dye capacity of the production equipment, and utilizes considerably less water per pound of goods dyed. Furthermore, better dye yields and very level dyeings are obtained by virtue of the present process. Additionally, and very importantly, the tremendous and positively ecological and environmental benefits caused by the reduction of almost 50% in water consumption and effluents by virtue of the present process.

Still further objects and advantages will become apparent from a consideration of the ensuing description and accompanying examples.

SUMMARY

It is an object of the present invention to provide a water saving process for dyeing cellulosic containing materials with fiber reactive dyes.

It is another object of the present invention to provide an energy saving process for dyeing cellulosic containing materials with fiber reactive dyes.

Still further, another object of the present invention is to provide a time saving process for dyeing cellulosic containing materials with fiber reactive dyes.

Yet another object of the present invention is to provide a water, energy, and time saving and efficient process for dyeing cellulosic containing materials that is suitable for all types of fiber reactive dyestuffs.

And finally another object of the present invention is to provide perfect even dyeings without the need of dosification of the dyestuffs, the electrolyte, or the alkali into the dye bath, and furthermore perform the dyeing and the soaping in the presence of glacial acetic acid.

Generally speaking, the dyeing process for cellulosic containing materials according to teachings of the present invention includes the steps of scouring the textile material to render same suitable for dyeing without rinsing, while avoiding residual materials that will interfere with dyeing; souring the material in the dye bath with a suitable acid whereby alkali from the scour operation is neutralized and the material is rendered slightly acidic, and adding a dye assist system which reduces hydrolysis of the dyes and is stable to high alkali and high electrolyte content; adding a predetermined fiber reactive dyestuff formulation to the dye bath to achieve a desired shade; adding from about 5 to about 200 grams per liter of electrolyte to the dye bath to permit proper exhaustion of the dyestuff; raising the dye bath temperature to the required dyestuff formulation dyeing temperature; adding appropriate quantity of stable buffered alkali that permits proper fixation and a bath pH of from about 8 to about 12.5, subjecting the material to the dye bath at a predetermined time-temperature relationship to dye said material to said desired shade; and finally rinsing, after-scouring with glacial acetic acid and soaping agent, and rinsing said material.

In dyeing cellulose containing materials according to teachings of the present invention, a significantly shorter dye cycle from pre-scour through after-scour is realized, whereby significantly less energy is required for the overall process, and whereby less labor is utilized per pound of goods processed; with the use of the dyeing process of the present invention any color can be dyed from pre-scour through after-scour in less than 5 hours and using only from 5 to 6 liquor baths. Such of course reduces the overall cost of the dyeing operation, raises the dye capacity of the production equipment, and utilizes considerably less water per pound of goods dyed. Furthermore, better dye yields and very level dyeings are obtained by virtue of the present process. Additionally, and very importantly, the tremendous and positively ecological and environmental benefits caused by the reduction of almost 50% in water consumption and effluents by virtue of the present process.

The novel process of the present invention is a challenge to state of the art fiber reactive dyeing procedures, is as if it was designed to "defeat the purpose" in every important step of the process per se, anyone skilled in the art would expect obviously disastrous results as the logical outcome; no rinsing after the scouring operation, dyeing reactive dyes in the presence of glacial acetic acid, no dosing of dyes, no dosing of electrolyte, no dosing of alkali, soaping with glacial acetic acid; what else can you expect but faulty dyeings with such a process?. Surprisingly the results are absolutely the opposite, we get perfectly even dyeings, even the most difficult colors, like the greens, camels, beige's and grays, and even deep royals with reactive blue C.I.# 19 come out even and in less than 5 hours complete process time.

BRIEF DESCRIPTION OF THE INVENTION

In general the process of the present invention is directed to dyeing operations in which fiber reactive dyestuffs are employed to dye cellulosic containing materials such as cotton and rayon. The cellulosic component may be represented by fiber, yam, woven, knitted, nonwoven or other structure. The present invention relates to a process for dyeing with reactive dyes on cellulose substrates, starting with the raw substrate and ending up with the ready to be finished substrate in a time of 5 hours or less and requiring from 5 to 6 liquor baths only.

It is of common knowledge to all skilled in the art, that the complete process of dyeing cellulose fabrics with fiber reactive dyes starting from the raw takes at least in the best of cases 7 hours, and it is well known than in common practice a very good average time is 8 hours.

The present invention takes at the most 5 hours, which in a 24 hour time period we get 5 dye lots out of 1 dyeing machine against 3 conventionally dyed dye lots out of 1 dyeing machine in the same 24 hour period. That is two-thirds increase in production, which will definitely cause quite a positive impact in the art.

The present invention does not contemplate just the dyeing part of the process, it contemplates the dyeing system as a whole, in other words the scouring and preparation of the goods to be in optimum conditions to be dyed, the dyeing of the goods in such a way that very little hydrolyzed dye is left over for the third stage of the process to be fast and effective, which is the after-scouring or soaping stage, the removal of the dyestuffs that did not get fixed on the substrate during the dyeing stage.

Materials to be dyed according to the present process are scoured for 5 to 15 minutes at 95° C. to 110° C. to remove wax, dirt, knitting emulsions and other materials to generally clean the material while avoiding the use of chemical systems that will leave residual components which could retard the dyeing. Thereafter, the scoured material is cooled by overflow to about 40° C., and without any further rinse, acid souring and dyeing are performed in the following bath.

Insofar as the dye bath is concerned, a low liquor volume is preferred, preferably in a liquor to material weight ratio range of about 15 to from about 20 to one for beck dyeing and for jet dyeing from about 5 to about 10 to one. In case that the scoured material was simultaneously bleached, care should be taken as not to have any hydrogen peroxide residues present in the dye bath. Once the bath is free of peroxide, bath temperature is adjusted, if necessary, to a range of from about 20° C. to about 40° C.

The order of addition of chemicals and dyestuffs is critical. First, the acetic acid is introduced into the dye bath. Second, the dyeing assist agent is introduced. Third, the dyestuffs are introduced in the dye bath, and fourth the electrolyte is introduced to the dye bath, this 4 components introduced at the initiation temperature of about 20 to about 40° C. Thereafter the dye bath temperature is raised to the desired dyeing temperature in a time period of about 10 to 20 minutes for 60° C. dyeings and about 15 to 30 minutes for 80° C. dyeings. Ten minutes after the desired dyeing temperature is reached, the alkali is introduced in the dye bath in one portion and dyeing is carried on for a further 20 to 60 minutes.

Subsequent to dyeing, the materials are cold water rinsed, soaped in the presence of acetic acid and soaping agent, hot water rinsed, and cold water rinsed for dark and very dark shades;

Cold water rinsed, soaped in the presence of acetic acid and soaping agent, and cold water rinsed for medium shades; and Soaped in the presence of acetic acid and soaping agent and cold water rinsed for light and pastel shades.

Afterwhich the then dyed materials are further processed as intended.

In dyeing cellulose containing materials according to teachings of the present invention, a significantly shorter dye cycle from scour through after-scour is realized, whereby significantly less energy is required for the overall process, and whereby less labor is utilized per pound of goods processed; with the use of the dyeing process of the present invention any color can be dyed from scour through after-scour in less than 5 hours and using only from 5 to 6 liquor baths. Such of course reduces the overall cost of the dyeing operation, raises the dye capacity of the production equipment, and utilizes considerably less energy and water per pound of goods dyed. Furthermore, better dye yields and very level dyeings are obtained by virtue of the present process. Additionally, and very importantly, the tremendous and positive ecological and environmental benefits caused by the reduction of almost 50% in water consumption and effluents by virtue of the present process.

THEORY OF OPERATION—DESCRIPTION

The scouring operation is fast and effective because of the auxiliary components and the synergy between them:

The surfactant has as its main ingredient about 40% of a 13 mole nonyl phenol ethoxylate, which is effective at boiling temperatures since it has a high cloud point as compared to 9 and 10 mole nonyl phenol ethoxylates which have a cloud point of 52° C. and 60° C. respectively, and above those temperatures they act against instead of for the purpose of cleaning. The disadvantage of 13 moles is that its more difficult to rinse-off the fabrics, but that problem is overcomed by the dispersability and sequestering properties of the polyacrylates that are present in the surfactant.

In addition, the presence of about 6.5% Toluol perfectly emulsified in the surfactant plus the presence of Tween-.RTM. and Span.RTM. on the surfactant formulation make it possible for having any cellulosic containing material in optimum conditions to be dyed in a scouring time of 5 to 15 minutes at the boil.

The other product that goes in the pre-scour is a stable buffered alkali, which is much more easier to rinse-off the fabric than caustic soda or soda ash, which are used on cellulose scouring 99.9% of the time.

The combination of both products makes it possible to start the dyeing operation in the next bath, just by cooling with overflow is sufficient to get rid of all the waxes, dirt, oils, soil, grease, surfactant, and alkali.

The inventor in plant trials has proved this theory to work whereby in 40 minutes and one water bath only the goods were in optimum condition to be dyed.

As for the dyeing the operation, its started immediately after the sole scour bath is dropped, with the addition of glacial acetic acid, which not only serves as the pH bath neutralizer, while I also believe it serves as the compatibilyzer between the sodium-meta nitrobenzenesulphonate and the sodium polyacrylate, I don't wish to be bound by this; which serve as the leveling and anti-hydrolyzing system of the dyeing operation of the present process. Sodium polyacrylate is not compatible with oxidizing agents, and sodium-meta nitrobenzenesulfonate is an oxidizing agent used to prevent the reduction of the fiber reactive dyes and thus hydrolysis. The presence of the glacial acetic acid also prevents hydrolysis of the fiber reactive dyes, it is known, for example, that dyeings from dyes of the vinyl sulphone type are resistant to acid hydrolysis, the ether being more stable to the glucoside linkage in cellulose; the link with cellulose is, however, susceptible to alkaline hydrolysis when the vinyl sulphone is reformed.

It is because of the combination of the 3 products above mentioned that the dyestuffs are added to the dye bath in one portion in a time period of from 5 to 10 minutes, without the need of long dosing in portions as is done in conventional dyeing processes, and in the same manner, the electrolyte is added to the dye bath in a 5 to 10 minute period instead of the 20 to 30 minutes as done conventionally.

The reason why the alkali is not added at this point or before the addition of the electrolyte, but instead the temperature is raised to 60° C. or 80° C. and a 10 minute period holding time at the dyeing temperature is taken before the addition of the alkali takes place, is because from liquor ratios of 5:1 and above, it is advantageous to transfer the maximum amount of dye to the fibre prior to alkali addition by addition of electrolyte. By so doing, a substantial quantity of dye may be sorbed under neutral conditions and hence be applied in a level fashion; and also, in the 30 or 40 minute time period from the addition of the electrolyte to the addition of the alkali, about 70% of the reactive dyes are sorbed, leaving about 30% of the dyes in the dye bath to compete with OH (−) and the CellO (−).

The alkali is added to the dye bath in a time period of 5 to 10 minutes, without the need of dosing in portions or spending money in costly dosing equipment, because the stable buffered alkali used in the process of the present invention has the ability to maintain the pH constant during the process, with variations of less than 0.1 in pH over a 50 minute dyeing time period, therefore loosing time in programmed dosing is absolutely not necessary, sudden strike rates of dyestuffs are avoided since the pH is maintained constant, better reproducibility is obtained and less dyestuff is hydrolyzed by avoiding [high alkali-high temperature-long time] exposure, making the next step of the process, the after-scouring or soaping step, much faster and simpler since the amount of hydrolyzed dye has been minimized and controlled all through the dyeing process.

As for the after-scouring, acetic acid is used simultaneously with the soaping agent, thus no neutralizing bath is required between the dye bath and the soaping bath; the soaping agent is made of about an 18,000 to 24,000 molecular weight polyacrylate which is capable of sequestering the hydrolyzed dyestuffs and prevents their redeposition on the substrate, thus 99.9% of the time one soaping bath is sufficient to get excellent washfastness properties from the dyed substrate.

It is the above mentioned combination of features and dyeing chemical auxiliaries that permits the reactive dyeing process of the present invention to perfectly work in less than 5 hours and requires at the most 6 water baths.

As for the dyeing chemical auxiliaries, the scouring agent, Texdet SS, has the unique feature of being able to optimally prepare the substrate for dyeing in just 5 to 15 minutes, which is a novelty to the prior art. As for the dyeing assist agent, Antydrol A, its components are known to the prior art as separate individual components for different applications and not as a leveling anti-hydrolyzing agent product per se. In regards to the soaping agent, Texsoap FT, the sodium polyacrylate~20,000 MW is not known to the prior art as being used as a soaping agent. Moreover, as for the stable buffered alkali, Alkatex F, many similar products are known in the prior art, but none with the feature of maintaining a pH value with a variation of less than 0.1 throughout the entire dyeing process.

The above mentioned dyeing chemical auxiliaries that complement the success of dyeing process of the present invention are formulated as follows: All formulations are given in parts by weight.

| | | | |
|---|---|---|---|
| Texdet SS | | | |
| Nonyl Phenol - 13 moles EO (40%) | 82.6 | 18.3 | |
| Nonyl Phenol - 10 moles EO | — | 16 | |
| Nonyl Phenol - 30 moles EO (35%) | — | 45.04 | |
| Tween.RTM. 80 | 0.72 | 0.56 | |
| Span.RTM. 80 | 0.03 | 0.022 | |
| Toluol | 6.65 | 5.1 | |
| Sodium Polyacrylate MW 5,000 | 10 | 14.978 | |
| Antydrol A | | | |
| Sodium-meta Nitrobenzenesulfonate (20%) | 79.7 | 71.58 | |
| Sodium Polyacrylate MW 5,000 | 20 | 28 | |
| Glacial acetic acid | 0.3 | 0.42 | |
| Texsoap FT | | | |
| Sodium Polyacrylate MW 20,000 (40%) | 80 | 50 | |
| Water | 20 | 50 | |
| Alkatex F | | | |
| Sodium Hydroxide (50%) | 30 | 30 | — |
| Potasium Hydroxyde (55%) | 32 | 32 | 25 |
| Potasium Carbonate (48%) | — | — | 63 |
| Phosphoric acid (20%) | 30 | 38 | — |
| EDTA | 3 | — | 5 |
| Sodium Polyacrylate MW 3,000 | 5 | — | 3 |
| Phosphoric Acid (50%) | — | — | 4 |

DETAILED DESCRIPTION OF THE INVENTION

Since non-of the process stages is conventional, all the ingredients and conditions for these stages are critical and highly preferred. As such, each of the general process steps will be described with specific detail, alluding as to each, any criteria that could adversely affect the dyeing operation, or that is preferred or critical.

Scouring: Specifics of the scour operation are dictated by the color shade that is desired, and mainly there are two basic operating methods:

a) Medium, dark, and very dark shades, and b) Light or pastel shades.

First of all it should be taken into account that all through the process of scouring, dyeing, and after-scouring the material must be running at the fastest permissible travelling speed through the bath liquor, and if necessary an antifoaming agent and a dye bath lubricant could be used in the scouring and in the dyeing operations, no other chemicals should be added unless specified.

a) For Medium, Dark and Very Dark Shades the Scouring is Carried Out in the Following Manner:

Once the dyeing machine is loaded with the material and material is running, open the steam valve completely and add to th e scour bath through the chemical feeding tank from about 0.8 to about 1.5 grams per liter of Texdet SS, a non-ionic blend of adducts of ethylene oxide, sorbitols, polyacrylates, and solvents; once the product is in the bath, add from about 0.5 to about 2 cc/l (cubic centimeter per liter) of Alkatex F, a stable buffered alkali which is a blend of alkali metal hydroxides, alkali metal carbonates, and phosphoric acid, diluted with plenty of water and feed it through the feeding tank in a time period of about 1 minute, keep in mind that steam valve should be completely open until we reach a temperature of from about 95° C. to about 110° C. The scour bath should be held for about 5 to 8 minutes at 110° C. and about 10 to at the most 15 minutes at the boil, afterwhich the scour bath is cooled to about 80° C. and the overflow valve is open until a temperature of about 40° C. is reached and the scour bath is dropped. No further rinse is necessary; we go directly to the dyeing bath right after this scouring procedure. The scour operation of the dyeing process of the present invention should take about 40 to 50 minutes and requires only one water bath.

b) For Light or Pastel Shades the Procedure is as Follows:

Adding about 0.8 to 1.5 g/l Texdet SS, increasing the amount of Alkatex F to from about 0.5 to about 2 cc/l, and adding anywhere from about 1 to about 5 grams per liter of hydrogen peroxide (50%), the amount of peroxide determined by the degree of whiteness that is required to be achieved, and if desired a non-silicate peroxide stabilizing agent could be added to the bath; once boiling temperature is achieved the scouring/bleach bath is kept at boiling temperature for 30 minutes, or could be held for about 15 minutes at 110° C.; then cooled indirectly to 80° C., and then cooled by overflow to about 35° C. and the bath is dropped. Now we proceed with a 5 to 10 minute hot water rinse (from 50° C. to about 80° C.), cooling then by overflow to 35° C., dropping the bath and we are now ready to proceed with the dyeing operation of the process. The scouring/bleach operation of the dyeing process of the invention should take about 80 to 90 minutes and requires two water baths.

For the dyeing operation of the process of the present invention we proceed as follows: The vat is filled with a low water level, taking into account the volume needed for the dyeing assist agent, the dyestuffs, the electrolyte and the alkali, thereafter from about 0.1 to about 0.2 g/l of glacial acetic acid is added to the dye bath through the feeding tank diluted with water, the goods are runned for about 3 minutes and anywhere from 2 to about 5% of Antydrol A, an anti-hydrolysis leveling assist, which is a blend of low foaming sulfonated oxidizing agents and polyacrylates, is added to the dye bath and after 5 minutes the dissolved reactive dyes are added to the dye bath through the feed tank in a time period of 5 minutes for dark, and very dark shades and 10 minutes for medium, light and pastel shades; once the dissolved reactive dyes are in the dye bath the goods are left running for 5 minutes for dark and very dark shades and 10 minutes for medium, light, and pastel shades; and now we proceed with the electrolyte addition which again should be fed into the dye bath in a period of 5 minutes for dark and very dark shades and 10 minutes for medium, light, and pastel shades, thereafter heating the dye bath to the desired dyeing temperature at a rate of about 1.5 to 3° C./minute; then 10 minutes after arriving to the dyeing temperature anywhere from 1.5 to about 6 cc/l of Alkatex F diluted at least 1:10 in water is added to the dye bath through the feed tank, making sure that the feed tank is full of dye bath liquor, and fed in a time period of 7 to 10 minutes, thereafter holding at the dyeing temperature for about 20 to 40 minutes for medium, light, and pastel shades and for about 45 to 60 minutes for dark and very dark shades, after which sample is checked for shade and the dye bath cooled by overflow to 40° or 35° C. and dropped. This Dyeing part of the dyeing process of the invention should take about 115 to 120 minutes and requires only one water bath.

The after-scouring operation of the dyeing process of the present invention is carried out as follows:

For light and pastel shades we load the vat with water and add from about 0.2 to about 0.4 g/l glacial acetic acid through the feed tank and diluted with plenty water, and after a time period of 3 minutes we open the steam valve completely and add from about 0.5 to about 1% by weight of the dry material of Texsoap FT, which is a low foaming soaping agent made out of polyacrylates with a molecular weight of about 18,000 to about 24,000, the bath temperature is raised to from about 70° C. to about 85° C., and after 5 to 10 minutes the bath is cooled by overflow to about 35° C. and the bath is dropped. Thereafter the material is subjected to a 5-minute cold water rinse and unloaded without dropping the rinse bath, which is used to pre-scour the next dye load.

For dark and very dark shades, the material is subjected to a 5-to 10 minute cold water rinse and the bath is dropped. Thereafter in a new bath we add from about 0.2 to about 0.4 g/l glacial acetic acid and after 3 minutes the steam valve is opened completely and from about 0.5 to about 1.5% of Texsoap FT is added to the after-scour bath then taken anywhere to from 80° C. to 105° C. and held at such temperature for from about 5 to about 20 minutes, thereafter the bath is cooled indirectly to 80° C., the overflow valve is opened and the bath cooled to about 40° C.and the bath is dropped. The material is then subjected to a hot water 5 to 10 minute rinse at a temperature of from about 60° C. to about 80° C. afterwhich the overflow valve is opened and the bath cooled to about 40° C. and the bath is dropped. Finally the material is subjected to a 5-minute cold water rinse and the goods are unloaded without dropping the final rinse bath, which will be used for the next dye load. For medium shades the hot water rinse is obviated. The after-scouring of light and pastel shades of the dyeing process of the present invention requires about 40 to 45 minutes and only 2 water baths, about 60 minutes and 3 water baths for medium shades, while dark and very dark shades require about 90 minutes and 4 water baths. It should always be observed that when the rinse and soaping baths are dropped, enough time should be given for the bath liquors to drain from the fabric.

The overall process time of the present invention is about 250 minutes for light and pastel shades, 260 minutes for medium shades, and about 280 minutes for dark and very dark shades, and the water consumption is 5 water baths for medium, light and pastel shades and 6 for dark and very dark shades.

The dyeing process of the present invention is a challenge to state of the art techniques, is as if it was designed to "defeat the purpose" in every important step of the process per se, anyone skilled in the art would expect obviously disastrous results as the logical outcome; no rinsing after the pre-scouring operation, dyeing reactive dyes in the presence of glacial acetic acid, no dosing of dyes, no dosing of electrolyte, no dosing of alkali, soaping with glacial acetic acid; what else can you expect but faulty dyeings with such a process?. Surprisingly the results are absolutely the opposite, we get perfectly even dyeings, even the most difficult colors, like the greens, camels, beige's and grays, and even deep royals with reactive blue C.I.# 19 come out even and in less than 5 hours complete process time.

The use, advantages, and benefits of the fiber reactive dyeing process of the present invention comprising the methods of scouring, dyeing, and after-scouring cellulose containing materials, will now be described in more detail by reference to the following specific, non-limiting Examples:

EXAMPLE 1

140 Kgs of a 24 single's 24 cut cotton jersey knit are to be dyed deep royal on an atmospheric winch dyeing machine with a liquor to fabric ratio of 20:1, 7–20 Kg pieces taking 1.5 minutes per turn.

For the scouring operation the following products were used:

1 g/l Texdet SS 1 g/l Texiube SN 0.8 cc/l Alkatex F

First, the surfactant and the dye bath lubricant were added, the steam valve opened completely, and then the alkali was added, the scour bath reached the boiling point in 12 minutes and the temperature was held for 10 minutes and the bath cooled in 10 minutes to 80° C., thereafter cooled by overflow to 40° C. and the bath was dropped.

The dyeing was performed in the next bath as follows:

0.12 g/l glacial acetic acid

4% Antydrol A 2.75% Cibacron.RTM. Blue FG-FN (Ciba Colors)

0.75% Cibacron.RTM. Red FB 60 g/l Sodium Sulphate 2 g/l Alkatex F

In the next bath 2400 lt. liquor were added and the goods were soured with glacial acetic acid, and 5 minutes later, the Antydrol A was added, and 10 minutes later the dyestuffs which had been dissolved in 150 liters water were added in a 10 minute period. 10 minutes later, 168 kgs of sodium sulphate were added over a 10 minute period, and after 10 minutes the dye bath temperature was raised to 60° C. in a time period of 20 minutes, and the temperature was held for 10 minutes, afterwhich 5.6 liters of Alkatex F dissolved in 100 liters water were added over a 10 minute time period, thereafter dyeing was continued at 60° C. for 50 minutes, and the goods were cooled to 40° C. by overflow.

The after-scouring operation was performed as follows:

a) a 10-minute cold water rinse;

b) the vat was filled with 2800 lt. of water, and 0.3 g/l glacial acetic acid was added, and then the steam valve was completely opened, and 3 minutes later 1.5% Texsoap FT were added, the bath temperature was taken to 90° C. in 10 minutes, and was held thereafter for a further 10 minutes, afterwhich it was cooled to 80° C. in 5 minutes, and then cooled to 40° C. by overflow;

c) a 5 minute hot 70° C. water rinse, and finally d) a 10-minute cold water rinse, the goods were unloaded without dropping the bath, which is subsequently used to pre-scour the next dye lot.

After drying and finishing the fabric was perfectly level and the washfastness and light fastness were excellent.

EXAMPLE 2

180 Kgs. of a 30 single's Tanguis cotton 28 cut jersey knit were loaded on an overflow ATYC dye machine, and dyed to a navy blue color in a 1,200 liter total bath (liquor ratio 6,7 to 1). The fabric speed was set at 240 meters/minute, scoured at the boil for 10 minutes with 1.2 g/l Texdet SS, 0.9 cc/l Alkatex F, 1 g/l Texlube SN, a monostearate dye bath lubricant manufactured by Tex-Chem Inc. of Coral Gables, Fla., and 0.2 g/l Foamaster.RTM. 340 antifoam from Rhone-Poulanc Co., the bath indirectly cooled to 80° C., and then cooled to 40° C. by overflow. The bath was dropped and in the next bath water was filled to the 950 liter level mark, the bath temperature was 30° C., and 0.13 g/l (based on 1200 liters) glacial acetic acid diluted in the dye bath liquor were introduced through the chemical feed tank, and after 3 minutes a sample of scoured fabric was taken to check pH and wettability, the fabric at this point had a pH of 6.7 and had outstanding wettability, then 3% of Antydrol A were introduced to the dye bath, and 5 minutes later the dyestuffs of the following formulation was introduced in a time period of 7 minutes, dissolved in 100 liters of water:

2.62% Remazol.RTM. Black BB (DyStar)

0.74% Remazol.RTM. Golden Yellow 3R 0.40% Remazol.RTM. Brilliant Red F3B

After 5 minutes, 70 g/l (based on 1200 liters) of sodium chloride were added to the dye bath in a 5 minute time period. The fabric was held running through the dye liquor for 5 minutes, and the dye bath temperature was raised to 60° C. in a time period of 20 minutes, and held at 60° C. for a further 10 minutes and then 4 cc/l of Alkatex F dissolved in 60 liters of water were introduced to the feed tank which had 100 liters of dye liquor in it, and were introduced in the dye bath in a 7 minute time period, the temperature was held for a further 45 minutes at 60° C., the dye bath cooled by overflow to 35° C. and then dropped. The fabric was then subjected to a 5 minute cold water rinse, the bath dropped and then in a 1800 liter new bath 0.4 g/l glacial acetic acid were introduced and steam valve fully opened, after 3 minutes 1.2% Texsoap FT was introduced and the bath taken to 95° C. in a 10 minute period and held at that temperature for 15 minutes, afterwhich the bath was indirectly cooled to 80° C., and then cooled by overflow to 40° C. and dropped. Then the fabric was subjected to a 5 minute rinse at 70° C., cooled by overflow to 35° C. and the bath dropped, and finally subjected to a 10 minute cold water rinse and the fabric unloaded without dropping the bath which could be used for the scouring of the next dye-lot. The results obtained for the dyed fabric of Example 2 were a deep navy blue color with outstanding leveling and very good wash fastness and light fastness properties. Furthermore, pH dye bath measurements were taken during dyeing at 5, 20 and 40 minutes after the alkali was introduced and the readings showed pH values of 10.8, 10.78, and 10.72 respectively.

EXAMPLE 3

150 Kgs of a 40/2 28 cut interlock Pima cotton knit fabric were loaded in a Scholl overflow jet dyeing machine, with 1,200 lt. of water, liquor to fabric ratio of 8 to 1 and a Royal Blue was dyed in the following manner: Scouring for 15 minutes at the boil with:

1.5 g/l Texdet SS 1.1 cc/l AlkatexF 1.2 g/l Texlube SN 0.2 g/l Foamaster.RTM. 340 (Rhône-Poulenc)

The reason why we increase the amounts of surfactant and alkali is that Pima cotton needs a stronger pre-treatment than Tanguis cotton. The dyeing operation is carried out as follows:

0.15 g/l Glacial acetic acid

4% Antydrol A

4% Remazol.RTM. Brilliant Blue R Special (DyStar)

60 g/l Sodium Sulfate 3.0 cc/l Alkatex F

The dyeing was carried out at 60° C. the same way as example 2 but the dyeing time was 50 minutes after the addition of the alkali. The soaping operation was carried as in example 2. The results obtained for example 3 were a very level dyed Royal Blue with excellent wash and lightfastness.

EXAMPLE 4

150 Kgs of a 30 single's 28 cut cotton jersey knit fabric are to be dyed Olive Green in 1,500 lt., dye liquor ratio 1:10 in a Scholl jet dyeing machine. The scouring procedure was performed exactly as example 2; the fabric is dyed in the following manner:

0.13 g/l glacial acetic acid

3% Antydrol A 1.20% PROCION.RTM. Yellow HE4R (Zeneca colors)

0.46% PROCION.RTM. Red HE-3B 1.15% PROCION.RTM. Green HE4BD, and after 5 minutes 90 g/l Sodium Sulfate; all this products are added following the same sequence as Example 2, 5 minutes after the addition of the electrolyte, the dye bath temperature is raised to 80° C. in a time period of 30 minutes, and 10 minutes later 4 cc/l of Alkatex are added over a 10 minute period, afterwhich the dyeing is carried out for a further 45 minutes The after-scouring operation is performed as Example 2. A very level dyed olive green fabric is obtained with excellent fastness to washing and light.

EXAMPLE 5

150 Kgs of a 20 single's 24 cut cotton knit fabric to be dyed deep blue are loaded in a AKM overflow dyeing machine in a 10:1 liquor ratio. The scouring operation is carried in the same manner as with example 2; thereafter the dyeing operation is carried out with the following products:

0.13 g/l glacial acetic acid

3% Antydrol A

3% CIBACRON.RTM. Blue FGFN, are added in 5 minutes, and after 10 minutes 80 g/l Sodium Sulfate are added in a 5 minute time period; and 10 minutes later the temperature was raised to 60° C. in a 20 minute time period, and 10 minutes later 3 cc/l of Alkatex F, over a 10 minute time period were added, afterwhich dyeing was carried for a further 50 minutes. The soaping operation was carried as in Example 2

A deep blue dyeing with excellent leveling and fastness to light and washing was obtained.

EXAMPLE 6

180 Kgs of a 30 single's 28 cut jersey knit cotton fabric are to be dyed Kelly Green in a 1500 lt. bath, liquor ratio 8:1, in an overflow ATYC dyeing machine. The fabric is scoured at the boil for 15 minutes, using same procedure as in example 3. The dyeing is carried out as follows:

0.15 g/l glacial acetic acid

4% Antydrol A 4.06% REMAZOL.RTM. Turquoise RP (DyStar)

1.1% REMAZOL.RTM. Brilliant Yellow 4GL, added in 7 minutes, and 10 minutes later 70 g/l Sodium Sulfate were added in 7 minutes, after 10 minutes the temperature was raised to 80° C., and held for 10 minutes and 5 cc/l Alkatex F were added over a 10 minute time period, afterwhich the bath was held at 80° C. for a further 50 minutes. The after-scouring operation was done as follows:

a) a 5-minute cold water rinse;

b) soaped at 95° C. with 0.4 g/l glacial acetic acid and 1.5% Texsoap FT for 15 minutes;

c) a 5 minute 70° C. hot water rinse;

d) 5 minute cold water rinse & unloaded.

The results obtained were a perfectly even dyed Kelly green with excellent fastness to washing and light.

EXAMPLE 7

150 Kgs of a 24 singles double-piqué cotton fabric are loaded in a Scholl overflow dyeing machine to be dyed to a light mustard color in a 1,200 liter bath, a liquor to fabric ratio of 8:1; the goods are first scoured/bleached in the following manner:

1.5 g/l Texdet SS 1.5 cc/l Alkatex F 0.1 g/l STABICOL.RTM. A, a peroxide stabilizer from Allied Colloids inc.

0.2 g/l FOAMASTER.RTM. 340 (Rhône-Poulenc)

1.5 g/l Texlube SN 3 g/l Hydrogen Peroxide 50% the bath temperature was taken to the boil in 12 minutes and held for a further 30 minutes, afterwhich indirectly cooled to 80° C., and then cooled by overflow to 35° C. and dropped; the fabric was given a 5 minute 80° C. hot water rinse and cooled by overflow to 35° C. And dropped. The dyeing was done as follows:

0.1 g/l glacial acetic acid

2% Antydrol A 0.232% Synozol.RTM. Golden Yellow HF-2GR 150% (Kyung ln, China)

0.027% Synozol.RTM. Red HF6BN 150%

0.029% Synozol.RTM. Blue SHF-BRN 150% the dyes were added over a 10-minute time period dissolved in 100 lt. of water, and after 10 minutes 30 g/l Sodium Sulfate were added, over a 10 minute period, and 10 minutes later the temperature was raised to 60° C. in 20 minutes, held for 10 minutes and the addition of 2.2 cc/l of Alkatex F over a 10 minute period, the dyeing was performed for a further 30 minutes, afterwhich cooled by overflow to 30 ° C. and dropped. The bath was filled with 1,500 liters of water, 0.2 g/l glacial acetic acid were added and 3 minutes later 0.8% Texsoap FT were added and the temperature raised to 85° C., and held 10 minutes at 85° C., afterwhich the goods were cooled by overflow to 35° C. and the bath was dropped.

Finally a 5-minute cold water rinse was given and the fabric was unloaded without dropping the bath which served for the scouring of the next dye-lot. A very good level dyed fabric was obtained with excellent fastness to light and washing. Only 5 water baths were employed, or actually 4 if you consider that the last rinse bath is going to be used for the next dye-lot.

EXAMPLE 8

300 Kgs of 30 single's cotton yarn are to bee dyed brown in a Scholl pressure package yam dyeing machine, in a 10 to 1 liquor ratio.

For the scouring, we proceed as follows: Time pressure factor 3.5' in 4.5' out.

1.5 g/l Texdet SS 1.1 cc/l Alkatex F 0.3 g/l Foamaster.RTM. 340, taken to 110° C. in 14 minutes, and held at that temperature for 8 minutes, afterwhich the bath was cooled to 40° C. by overflow and dropped. The dyeing was performed in the next bath with:

0.2 g/l Foamaster.RTM. 340
0.14 g/l glacial acetic acid, then, after 8 minutes
3% Antydrol A, then, after 8 minutes
1.3% Synozol.RTM. Golden Yellow HF-2GR 150%
0.7% Synozol.RTM. Red HF-6BN 150%
0.6% Synozol.RTM. Black B 150%, the dyed added in 8 minutes, and after 8 minutes, 80 g/l sodium chloride are added, in 8 minutes, after 8 minutes the bath temperature was raised to 60° C. in 20 minutes time; 8 minutes later 4 cc/l Alkatex F were added, in an 8 minute time period, thereafter dyeing was carried out for a further 48 minutes, then was cooled to 30° C. by overflow and dropped, and in the next bath the soaping was performed by addition of 0.4 g/l glacial acetic acid and 1.5% Texsoap FT at 104° C. for 16 minutes afterwhich the bath was cooled to 40° C. by overflow and dropped. The yam was then subjected to a hot water 16minute rinse at 80° C., and then cooled by overflow to 40° C. and dropped. The yam was then subjected to an 8 minute cold water rinse, the bath dropped, and finally was subjected to a combined fixing and softening bath at 50° C. for 20 minutes with 0.2 g/l glacial acetic acid, 2.7% Tinofix.RTM. ECO, a diamine-epichlorohydrin blend fixing agent from Ciba, and 3% Texsoft PE, a cationic emulsified polyethylene softener. The yam was unloaded, the complete process took less than 5 hours, required only 6 water baths, fixing and softening included, excellent color leveling through the yam package was observed, a deep bright brown color was obtained which had excellent fastness to light and washing.

CONCLUSIONS, RAMIFICATIONS, AND SCOPE

Accordingly, it can be seen that in general the five, and six bath dyeing process according to teachings of the present invention is neither taught nor suggested by the known prior art; according to the present invention I have provided a method which allows the user to obtain reliable dyeings with all types of fiber reactive dyes, in a much shorter process time, with tremendous savings in water, energy and operation costs, and above all, the tremendous positive impact to the environment caused by the reduction of almost 50% in water consumption and effluents by virtue of the present process.

In utilizing the conventional fiber reactive dyeing process, not only is the dyeing operation expensive and time consuming, but the process is particularly energy intensive. with different baths, sometimes as many as 12 or 14, substantial energy is expended for raising the bath temperature from ambient to elevated temperature conditions at several intervals during the process. Moreover considerable rework is necessary due to shade variability and unlevel dyeings due to strike rate and hydrolysis of reactive dyes and unnecessary dyestuffs and chemicals are therefore wasted in larger amounts; and the protracted length of time required to complete the dyeing reduces the production capacity of the dyeing equipment.

Although the description above contains many specificities, these should not be construed as limiting the scope of the invention but as merely providing illustrations of some of the presently preferred embodiments of this invention. Various other embodiments and ramifications are possible within it's scope. For example, dyestuff additions for shade correction can be done at the dyeing temperature without the need of cooling or dropping part of the dye bath, adding the necessary amount of dyestuff in a 5 to 10 minute period, and the required alkali in the same manner. In addition, the process could be used for dyeing cellulosic containing materials blended with other fibers like nylon, polyester, etc. Besides, unloading the material without dropping the rinse bath and using it for pre-scouring the next dye lot can save extra water. Also, viscose rayon can be dyed with the process of the present invention by making slight changes, i.e. decreasing the amount of alkali and the temperature in the scouring operation, and increasing the amount of dye assist agent in the dyeing operation, etc.

Thus, the scope of the invention should be determined by the appended claims and their legal equivalents, rather than by the examples given.

What I claim as my invention is:

1. A process for dyeing cellulosic containing textile materials with fiber reactive dyestuffs comprising successively the stages of:

(a) scouring the textile material in a scouring bath which comprises a scour assistant that is stable to high alkali; and a stable buffered alkaline material that permits proper pH to the scouring bath, said scouring bath having a pH of from about 8 to about 11;

(b) dropping the scouring bath and without rinsing adding first acetic acid and then a dye assist system comprising sodium meta nitrobenzene sulfonate and sodium polyacrylate;

(c) adding a dyestuff formula containing at least one fiber reactive dyestuff;

(d) adding from about 5 to about 200 grams of electrolyte per liter of said dye bath;

(e) adding after the required dyeing temperature of the dyestuffs has been reached, a stable buffered alkaline material to said dye bath that permits proper fixation of dyestuff, said dye bath having a pH of from about 8 to about 12.5;

(f) subjecting said material to said dye bath; and (g) thereafter cold water rinsing, after-scouring with acetic acid and an after-scouring agent at a temperature of from about 80° C. to about 105° for a time period of about 5 to about 20 minutes, optionally hot water rinsing, and finally cold water rinsing said material, whereby from the scouring through the after-scouring's final rinse of said cellulosic containing textile material up to six water baths are used and the elapsed time is less than five hours.

2. The process as defined in claim 1 wherein the scouring bath contains from about 0.8 to 1.5 grams per liter of a nonionic scouring agent stable to high alkali and high temperature, and from about 0.5 to about 2 cubic centimeters per liter of a stable buffered alkali material; said nonionic scouring agent being a blend of adducts of ethylene oxide, sorbitols, polyacrylates, and solvents; said stable buffered alkali material being a blend of alkali metal hydroxides, alkali metal carbonates, and phosphoric acid, whereby from 5 minutes to about 15 minutes at a temperature of from about 95° C. to about 110° C. of said scouring bath are sufficient for said cellulosic containing textile material to be in optimum condition to be dyed, and whereby no intermediate rinsing baths are carried out between said scouring bath and the dye bath.

3. The process as defined in claim 1 wherein glacial acetic acid is added to the dye bath in an amount of from about 0.1 to about 0.2 grams per liter, whereby no intermediate neutralizing baths are carried out between the scouring bath and said dye bath.

4. The process as defined in claim 1 wherein the dye assist agent is added to the dye bath in an amount of from 2 to about 5 weight percent, said dye assist agent being a blend of low foaming oxidizing sulphonates, and polyacrylates of a molecular weight of from about 3,000 to about 6,000; said blend of low foaming oxidizing sulphonates, and polyacrylates of a molecular weight of from about 3,000 to about 6,000 minimizing hydrolysis and promoting level dyeings, whereby the dyestuffs are dosed to said dye bath in one portion in a time period of from about 5 to about 10 minutes, whereby the electrolyte is dosed to said dye bath in one portion in a time period of from about 5 to about 10 minutes, and whereby the stable buffered alkali material is dosed to said dye bath in one portion in a time period of from about 5 to about 10 minutes.

5. The process as defined in claim 1 wherein the fiber reactive dye is a dye having a reactive function selected from the group consisting of dichlorotriazine, monochlorotriazine, vinyl sulphone, monofluorotriazine, trichloro-pyrimidine, dichloro-quinoxaline, difluorochloro-pyrimidine, fluoro-chloromethyl pyrimidine, methylsulphonyl-chloromethyl pyrimidine, sulphatoethyl sulphonyl, phosphonic acid, or triphendioxazine.

6. The process as defined in claim 1 wherein the electrolyte is a member selected from the group consisting of sodium sulphate and sodium chloride.

7. The process as defined in claim 1 wherein from about 1 to about 6 cc/l of the stable buffered alkali material is added to the dye bath after the required dyeing temperature of the dyestuffs has been reached, said stable buffered alkali material being a blend of alkali metal hydroxides, alkali metal carbonates, and phosphoric acid.

8. The process as defined in claim 1 wherein the cellulosic containing textile material is subjected to an after-scouring bath in the presence of from about 0.2 to about 0.4 grams per liter of glacial acetic acid, and from 0.5 to about 1.5 weight percent of an after-scouring agent, said after-scouring agent being a blend of polyacrylates of a molecular weight of from about 18,000 to about 24,000, whereby no neutralizing baths are required between the dye bath and said after-scouring bath.

9. The process as defined in claim 1 wherein the cellulosic containing textile material is in the form of loose-stock fibers, yarn, woven fabric, knitted fabric, or nonwoven material.

10. The process as defined in claim 1 wherein a liquor ratio of from about 1:3 to about 1:30 on the weight of the dry cellulosic containing textile material is applied to the dye bath.

11. The process as defined in claim 1 wherein the cellulosic containing textile material is cotton.

12. The process as defined in claim 1 wherein the scouring bath and the dye bath may further include an antifoam agent and an anticrease lubricant.

13. The process as defined in claim 1 wherein the hot after-scouring's rinse for medium fiber reactive shade formulations can be obviated, whereby from the scouring through the after-scouring's final rinse of said cellulosic containing textile material five water baths are used and the elapsed time is less than five hours.

14. A process for dyeing cellulosic containing textile materials comprising successively the stages of:

(a) scouring and bleaching the textile material in a scouring/bleach bath which comprises a scour assistant that is stable to high temperature and alkali, an amount of hydrogen peroxide that permits required degree of whiteness of the cellulosic containing textile material, and an amount of stable buffered alkaline material that permits proper pH to the scouring/bleach bath, said scouring/bleach bath having a pH of from about 8 to about 11;

(b) subjecting said cellulosic containing textile material to from about a 5 to about a 10 minute hot water rinse at a temperature of from about 50° C. to about 80° C.;

(c) preparing a dye bath which comprises acetic acid and a dye assist system that minimizes hydrolysis, is stable to high electrolyte and alkali, and promotes level dyeings, said dye assist system comprising sodium meta nitrobenzene sulfonate and sodium polyacrylate;

(d) adding a dyestuff formula containing at least one fiber reactive dyestuff;

(e) adding from about 5 to about 200 grams of electrolyte per liter of said dye bath;

(f) adding after the required dyeing temperature of the dyestuffs has been reached, a stable buffered alkaline material to said dye bath that permits proper fixation of dyestuff, said dye bath having a pH of from about 8 to about 12.5;

(g) subjecting said material to said dye bath; and (h) thereafter after-scouring in the presence of acetic acid and an after-scouring agent at a temperature of from about 70° C. to about 105° C. and for a time period of about 5 to about 10 minutes, and finally cold water rinsing said material, whereby from the scouring/bleach through the after-scouring's final rinse of said cellulosic containing textile material up to five water baths are used and the elapsed time is less than five hours.

15. The process as defined in claim 14 wherein the scouring/bleach bath contains from about 0.8 to about 1.5 grams per liter of a nonionic scouring agent stable to high alkali and high temperature, and from about 0.5 to about 2 cubic centimeters per liter of a stable buffered alkali material; said nonionic scouring agent being a blend of adducts of ethylene oxide, sorbitols, polyacrylates, and solvents; and said stable buffered alkali material being a blend of alkali metal hydroxides, alkali metal carbonates, and phosphoric acid.

16. The process as defined in claim 14 wherein glacial acetic acid is added to the dye bath in an amount of from about 0.1 to about 0.2 grams per liter, whereby no intermediate neutralizing baths are carried out between the scouring/bleach bath and said dye bath.

17. The process as defined in claim 14 wherein the dye assist agent is added to the dye bath in an amount of from about 2 to about 5 weight percent, said dye assist agent being a blend of low foaming oxidizing sulphonates, and polyacrylates of a molecular weight of from about 3,000 to about 6,000, said blend of low foaming oxidizing sulphonates, and polyacrylates of a molecular weight of from about 3,000 to about 6,000 minimizing hydrolysis and promoting level dyeings, whereby the dyestuffs are dosed to said dye bath in one portion in a time period of from about 5 to about 10 minutes, whereby the electrolyte is dosed to said dye bath in one portion in a time period of from about 5 to about 10 minutes, and whereby the stable buffered alkali material is dosed to said dye bath in one portion in a time period of from about 5 to about 10 minutes.

18. The process as defined in claim 14 wherein the fiber reactive dye is a dye having a reactive function selected from the group consisting of dichlorotriazine, monochlorotriazine, vinyl sulphone, monofluorotriazine, trichloro-pyrimidine, dichloro-quinoxaline, difluorochloro-pyrimidine, fluoro-chloromethyl pyrimidine, methylsulphonyl-chloromethyl pyrimidine, sulphatoethyl sulphonyl, phosphonic acid, or triphendioxazine.

19. The process as defined in claim 14 wherein the electrolyte is a member selected from the group consisting of sodium sulphate and sodium chloride.

20. The process as defined in claim 14 wherein from about 1 to about 6 cc/l of the stable buffered alkali material is added to the dye bath after the required dyeing temperature of the dyestuffs has been reached, said stable buffered alkali material being a blend of alkali metal hydroxides, alkali metal carbonates, and phosphoric acid.

21. The process as defined in claim 14 wherein the cellulosic containing textile material is subjected to an after-scouring bath in the presence of from about 0.2 to about 0.4 grams per liter of glacial acetic acid, and from 0.5 to about 1.5 weight percent of an after-scouring agent, said after-scouring agent being a blend of polyacrylates of a molecular weight of from about 18,000 to about 24,000, whereby no neutralizing baths are required between the dye bath and said after-scouring bath.

22. The process as defined in claim 14 wherein the cellulosic containing textile material is in the form of loose-stock fibers, yarn, woven fabric, knitted fabric, or nonwoven material.

23. The process as defined in claim 14 wherein a liquor ratio of from about 1:3 to about 1:30 on the weight of the dry cellulosic containing textile material is applied to the dye bath.

24. The process as defined in claim 14 wherein the cellulosic containing textile material is cotton.

25. The process as defined in claim 14 wherein the scouring/bleach bath and the dye bath may further include an antifoam agent and an anticrease lubricant.

26. The process as defined in claim 14 wherein the scouring/bleach bath may further include a peroxide stabilizing agent.

* * * * *